US011541259B2

(12) United States Patent
Abascal Zuloaga

(10) Patent No.: US 11,541,259 B2
(45) Date of Patent: Jan. 3, 2023

(54) MACHINE FOR EXTINGUISHING FIRES

(71) Applicant: Maria Susana Abascal Rubio, Gorraiz (ES)

(72) Inventor: Jose Manuel Abascal Zuloaga, Gorraiz (ES)

(73) Assignee: Maria Susana Abascal Rubio, Gorraiz (ES)

( * ) Notice: Subject to any disclaimer, the term of this patent is extended or adjusted under 35 U.S.C. 154(b) by 998 days.

(21) Appl. No.: 16/324,749

(22) PCT Filed: Aug. 10, 2017

(86) PCT No.: PCT/ES2017/070576
§ 371 (c)(1),
(2) Date: Jun. 17, 2019

(87) PCT Pub. No.: WO2018/029391
PCT Pub. Date: Feb. 15, 2018

(65) Prior Publication Data

US 2019/0329079 A1 Oct. 31, 2019

(30) Foreign Application Priority Data

Aug. 11, 2016 (ES) ..... ES201631092

(51) Int. Cl.
*A62C 27/00* (2006.01)
*A62C 3/02* (2006.01)
*A62C 99/00* (2010.01)

(52) U.S. Cl.
CPC ..... *A62C 27/00* (2013.01); *A62C 3/0278* (2013.01); *A62C 99/0045* (2013.01)

(58) Field of Classification Search
CPC .... A62C 27/00; A62C 3/0278; A62C 99/0045
USPC ..... 169/48, 50, 52, 54, 91
See application file for complete search history.

(56) References Cited

U.S. PATENT DOCUMENTS

| | | | | |
|---|---|---|---|---|
| 4,852,656 | A | 8/1989 | Banahan | |
| 5,214,867 | A | 6/1993 | Weatherly et al. | |
| 5,864,970 | A * | 2/1999 | Maddock | E02F 3/246 37/94 |
| 5,894,893 | A * | 4/1999 | Nelson | A62C 27/00 169/52 |
| 6,591,520 | B1 * | 7/2003 | Abascal Rubio | A62C 99/0045 37/357 |

(Continued)

FOREIGN PATENT DOCUMENTS

| | | |
|---|---|---|
| ES | 2011522 A6 | 1/1990 |
| ES | 2111447 A2 | 3/1998 |
| ES | 2339517 A1 | 5/2010 |

(Continued)

*Primary Examiner* — Steven J Ganey
(74) *Attorney, Agent, or Firm* — Hayes Soloway PC

(57) ABSTRACT

A machine for extinguishing fires, using materials that are excavated and thrown directly from the ground includes a brush cutting module with knives and lateral panels, an excavating module comprising a cutter with spikes, and a throwing module formed by a flywheel mounted on a rotary shaft and provided with radial blades, allowing the excavated material to be thrown through openings in the throwing module. The position of the openings can be adjusted and the excavated materials can be thrown in one direction or another.

10 Claims, 5 Drawing Sheets

(56) References Cited

U.S. PATENT DOCUMENTS 6,702,032 B1 * 3/2004 Torras, Sr. ..... A01D 34/662
169/48

FOREIGN PATENT DOCUMENTS

| | | | |
|---|---|---|---|
| FR | 2602428 | A1 | 2/1988 |
| WO | 0066840 | A1 | 11/2000 |

* cited by examiner

MACHINE FOR EXTINGUISHING FIRES

OBJECT OF THE INVENTION

The present invention relates to a machine for extinguishing fires, the operation of which is based on throwing the excavated and crushed material, from the ground on which it passes, over the fire to be extinguished, having for that purpose three modules that are independent one to another but that can be functionally associated on a chassis, and said modules being: a brush cutting module, an excavating module and a throwing module, such that the three can work integrally attached to a chassis, or just two of them (the excavating module and throwing module), or even just one of them, acting on the chassis, where in the latter case the same module performs two functions simultaneously, acting as an excavating and throwing module, and having their hitching means on the three different chassis, also they can be mounted on autonomous vehicles.

The object of the invention is to provide a highly versatile machine for extinguishing fires, as it can work with three modules simultaneously, or said modules can be mounted separately or independently, in a composed way, which enables building a special machine that can be adapted to the conditions of the areas on which it is operating.

BACKGROUND OF THE INVENTION

Various types of autonomous machines used in extinguishing fires are known, i.e. having power means to operate, both for moving the machine and for actuating the different components of the machine to perform the brush cutting, excavation and throwing of ground, such that a specific type of machines include a front cutter bar for cutting bushes and trees, followed by a bulldozer to remove obstacles, and then a milling cutter for excavating and crushing the ground, leaving it "in situ", such that after said milling cutter there is arranged a harvesting knife for lifting up the excavated material, also having a chain or chains with buckets for loading and lifting up the excavated material collected by the aforementioned knife, said material reaching a rotary receiving hopper the function of which is to collect and deliver the material to a throwing-crushing element in correspondence with the rear part, wherein the throwing-crushing element has the purpose of throwing the material to the fire to be extinguished, having the particularity that this throwing-crushing element is mounted on a rotary platform.

In machines of this type, the throwing element has a single, fixed-size outlet opening, such that in order to throw the stream of material vertically, the throwing element itself moves, being powered laterally and made up of a single flywheel carrying the corresponding blades for crushing and throwing, and, in order to reach the horizontal angles, the platform on which the throwing element is fixed is used.

The type of machines referred to above are structurally complex, heavy and expensive, where the transmissions to the various hydraulic drive elements even further increase the cost of the assembly of the machine. Furthermore, the cutter bar, the milling cutter and the receiving hopper, with the throwing-crushing element, are linked with means for lifting up and lowering such components, for the purpose of trying to achieve the best and most effective functionality thereof, such that those lifting and lowering means undoubtedly affect the final cost of the machine, in addition making it more complex.

DESCRIPTION OF THE INVENTION

The proposed machine for extinguishing fires presents certain features and innovations with respect to conventional systems and machines which lead to substantial advantages in performance, as will be seen throughout the present description.

More specifically, the machine of the invention comprises three independent modules that can be functionally associated one to another, mounted on a chassis suited to the specific application to allow the machine to work with one, two or all three modules, indistinctly.

The first module is a brush cutting module and is formed by a knife with two lateral panels, the knife having a saw profile and a "swallowtail" shape, all mounted on a rigid arm mounted on the chassis, the height of which can be adjusted, to enable placing said brush cutting element, or knives as such, at more or less depth, according to the features of the ground.

On the rear end of the shaft on which the assembly of knives and panels is mounted, there is mounted, on a specific support, a hydraulic motor, the shaft of which ends in a cam shape to provide vibrational rotary movement to the brush cutting module, imparting constant vibrations.

The knives can be substituted by angularly placed concave discs which may, or may not, be subjected to vibration.

The described brush cutting module is placed on the front part of the machine.

The second module, constituting the excavating module, includes a milling cutter that can be provided with replaceable spikes along its entire perimeter and width, there being a larger or smaller number of spikes according to the size of the machine.

The spikes on the milling cutter of the excavating module can be alternated with pushing paddles for pushing the material, establishing means for feeding the third module, constituting the throwing module, or means for throwing them directly against the fire.

The milling cutter can be variable depending on the ground on which it is to work, and it can be provided with knives in the form of pointed hoes or planar knives substituting the spikes, and it can work in one rotating direction or the other rotating direction to enable the material to be excavated and lifted to the throwing module, or excavating and throwing the material in the form of a stream against the fire.

In both versions, the spikes and hoes or knives are working in the upper part thereof and covered with a metal casing, the throwing part being covered in turn by the same metal casing which guides the stream of materials excavated.

It also may, or may not, have a counter-knife which controls the size of the rocks in the event that the materials have to be fed into the throwing element and work from bottom to top in the clockwise direction.

As regards the throwing module, in a first embodiment it is made up of a flywheel with a shaft placed in the same direction of movement of the machine, on said flywheel there are mounted two, three or four throwing paddles of the material, said flywheel being closed by two discs, a front disc and a rear disc, and by a peripheral casing, such that the rotation of such flywheel, and therefore of the shaft, implies the expulsion or throwing of the material through an opening established for that purpose on the casing.

The casing fixed to the disc that is next to the flywheel has attached thereto a 360° gear ring on which acts a pinion moved by a hydraulic drive or motor which positions the outlet opening for the materials in the 360°.

In relation to this first embodiment, the throwing element, instead of being placed longitudinally, can be arranged with its axis transverse to the direction of movement and supported on just one of the closing discs of the flywheel with its paddles, allowing access of the materials, by means of the pushing generated by a worm screw which in turn is fed by an excavating-throwing milling cutter.

It also incorporates a universal joint of transmission in which an inverter is placed which allows throwing the materials in the clockwise or in the counterclockwise direction.

In a second embodiment of the throwing module, it can have several planar paddles with a cross shaft at 90° with respect to the direction of movement and is made up of several flywheels and paddles or radial blades.

In a third embodiment, the throwing module would be provided with spikes placed on the periphery of the flywheels, i.e., the milling cutter plus the paddles described above, excavating with the peripheral spikes and throwing the material with the central paddles, in that case, the excavation and throwing functions are combined in a single module.

The machine can be provided with its own means for autonomy as regards to mobility and operation, or it can be provided with hitch means and a power take-off with respect to a pulling tractor vehicle.

It should be mentioned that the first embodiment of the throwing module also includes pistons for positioning the material throwing fans, and that the direction of rotation is determined by the selection made by means of a lever.

The three basic modules comprised in the machine offer different assembly possibilities and will be proportional to the power and weight of each vehicle and to the type of ground of each area.

Thus, for the case of tractors with D.T. rubber tires, with a front and back hydraulic lift and power take-off, the machine can include a front brush cutting module and a rear throwing module, being 360° reversible.

There can also be mounted a front throwing module with a brush cutting module, spikes and paddles, also with a rear assembly being 360° reversible.

It can likewise include front throwing module with a brush cutting module, hoes with knives and paddles, or a rear throwing module being 360° reversible.

It can also include a 360° front throwing module with lifting spikes, with or without a brush cutting module.

In tractors of this type, there can also be mounted a 360° front throwing module with lifting hoes, with or without a brush cutting module.

In the event that the pulling tractor is having chains with a blade front and without a rear power take-off, then there may be mounted in the machine a 360° rear throwing module with a lifting milling cutter having spikes or hoes or knives, according to size of the tractor and the type of materials of the ground, with a proportional heat engine.

When the tractors have lightweight rubber chains with a hydraulic lift and front and rear power take-off, then there may be mounted in said vehicle:

- A front brush cutting module and a rear throwing module being 360° reversible.
- A front throwing module with a rear brush cutting module, spikes and paddles, 360° reversible.
- A front throwing module with a rear brush cutting module, hoes and paddles, 360° reversible.
- A 360° front throwing module with lifting spikes and paddles, with or without a brush cutting module.
- A 360° front throwing module with lifting hoes and blades, with or without a brush cutting module.

The machine can also be pulled by off-road 4×4 vehicles with a power take-off and a lifter, in the front or the rear or both.

Finally, the machine described as the third embodiment may also have the size of a walking tractor, in which the operation is controlled by the operator manually or through a system of brakes, since the excavation by the spikes and paddles drive the assembly forward.

By using one, two or all three modules, extinguishing machines which throw out from 15 to 500 tons per hour, or more, can be manufactured.

DESCRIPTION OF THE DRAWINGS

As a complement to the description that will be provided herein, and for the purpose of helping to make the features of the invention more understandable, according to a preferred practical exemplary embodiment thereof, said description is accompanied by a set of drawings constituting an integral part thereof in which, by way of illustration and not limitation, the following is represented.

PREFERRED EMBODIMENT OF THE INVENTION

Figure 1:
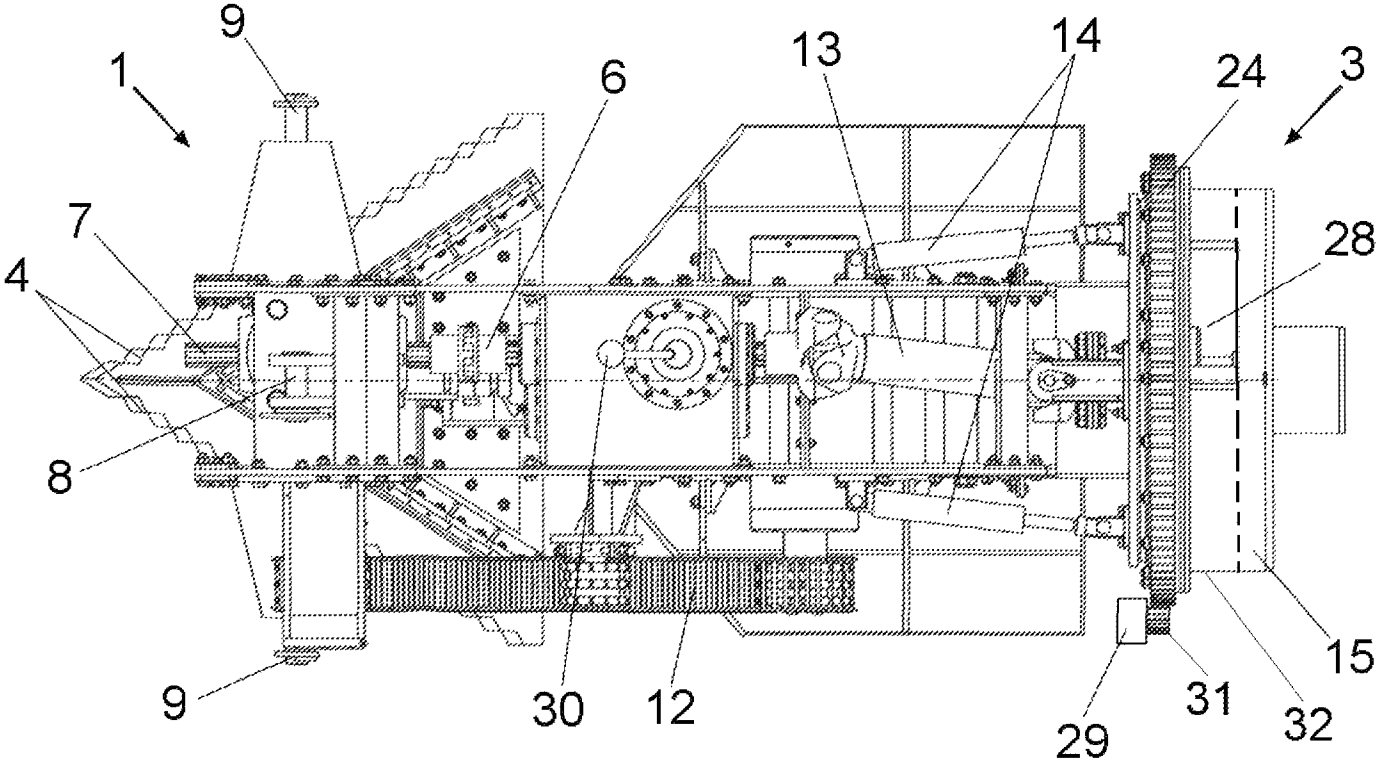
FIG. 1 shows a plan view of a machine for extinguishing fires carried out according to the object of the present invention, which primarily shows the power take-off and hitch means, the front "swallowtail"-shaped knife, the transmission means and the throwing module.
Figure 3:
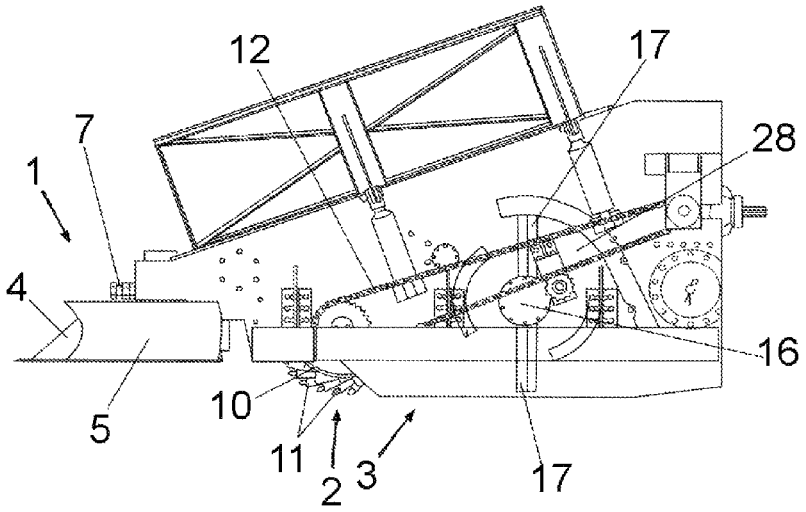
FIG. 3 shows a detailed lateral view of part of the machine which allows seeing the brush cutting module corresponding to the second embodiment, the excavating module and the throwing module with a shaft at 90° with respect to the direction of movement.

In view of the described figures, it can be seen how the proposed machine for extinguishing fires provided for extinguishing fires is made up of the combination and association, or the lack thereof, of three independent modules which can be mounted and removed separately or together on a common chassis, the modules of which are a brush cutting module (1) placed on the front part in the example of FIG. 1, an excavating module (2) placed in FIG. 3 after the preceding module, and a throwing module (3) for throwing the cut and excavated material, moved by a universal joint of transmission (13) with an intercalated inverter, as can be seen in FIG. 1.

The brush cutting module (1) of FIG. 1 comprises a cutting knife (4) with a saw edge, combined with a pair of panels (5), the "swallowtail" configuration adopted by the knife (4) being shown in FIG. 1.

Said brush cutting module (1) is mounted on a support or arm, the height of which can be adjusted to thus adjust the distance of said module from the ground.

The brush cutting module (1) is complemented with a hydraulic motor (35) with a cam at the end of its shaft as a vibration generating mean in said module.

In correspondence with the output of the transmission, a coupling (6) can be provided between the output shaft of the axle box and the input shaft of the inverter.

A power take-off (7), a hitch point (8) (third point) and lateral hitch points (9) are provided on the chassis on which the assembly of the modules (1), (2) and (3) is mounted, to enable pulling and driving by a tractor vehicle.

Figure 4:
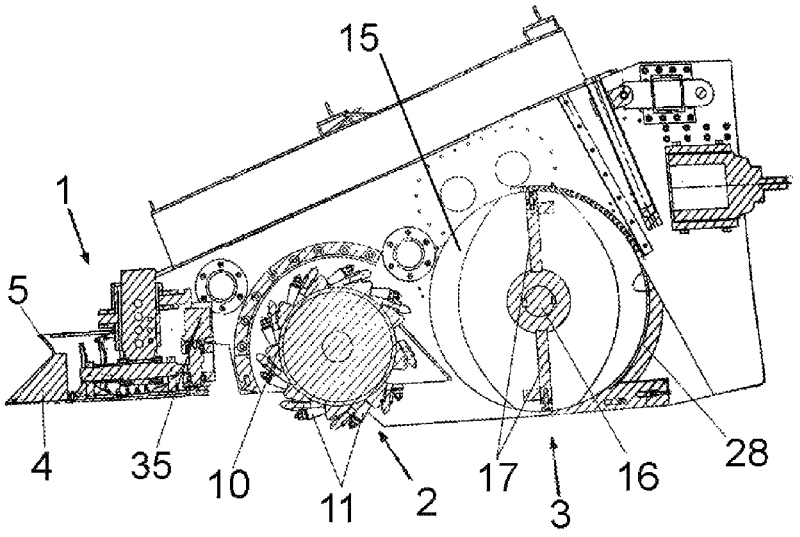
FIG. 4 shows a cross section detail of the same machine represented in the preceding figure which shows the brush cutting module, the excavating module and the throwing module.

The excavating module has been provided after the brush cutting module (1), said excavating module being made up of a milling cutter (10) of FIG. 4 with spikes (11) on its periphery, which are replaceable and may be alternated with pushing paddles.

FIG. 1 furthermore shows the transmission chain (12), as well as other elements such as a pair of pistons (14), a flywheel (15) of the throwing module (3), a pinion (31), a slew ring (24), and other elements which will be explained throughout the present description.

Figure 5:
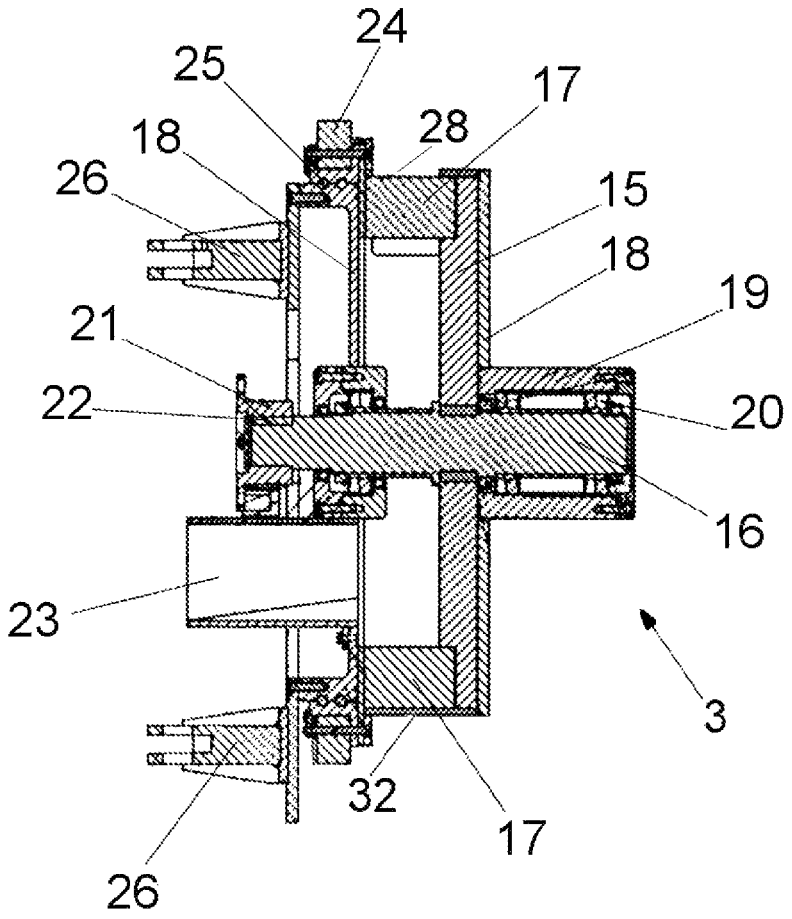
FIG. 5 shows a cross section detail of one of the embodiments of the throwing module.

FIG. 5 shows how the throwing module (3) includes the aforementioned flywheel (15) carrying radial blades (17), mounted on a rotary shaft (16), the flywheel (15) being arranged between discs (18), a front disc and a rear disc, attached one to another by a casing (32) where the outlet opening (28) for the materials is provided, such that the disc (18) is welded to a box (19) on which there are arranged bearings (20) of the shaft (16) which, at the other end thereof, is mounted on an enclosure (21) and with the interlocking split pin (22) thereof.

The inlet (23) for the materials excavated by the milling cutter (10), comprising the slew ring (24) for the throwing module (3) itself, the bearings (25), and even the fixing or mounting supports (26) for said throwing module (3), can also be seen in said FIG. 5.

In this throwing module (3) of the first embodiment, a casing (32) is defined in which an opening (28) is established, the circular positioning of which can be adjusted by means of a hydraulic drive (29), as detailed in FIG. 1.

A ring (24) attached to the casing or box (32) in which the flywheel (15) rotates is also included.

The outlet opening (28) for the materials is positioned by means of the hydraulic drive or motor (29).

It also includes a lever (30) for selecting the direction of 360° rotation for driving the material.

It also includes two pistons (14) imparting to it a horizontal movement of 15° on each side.

Figure 2:
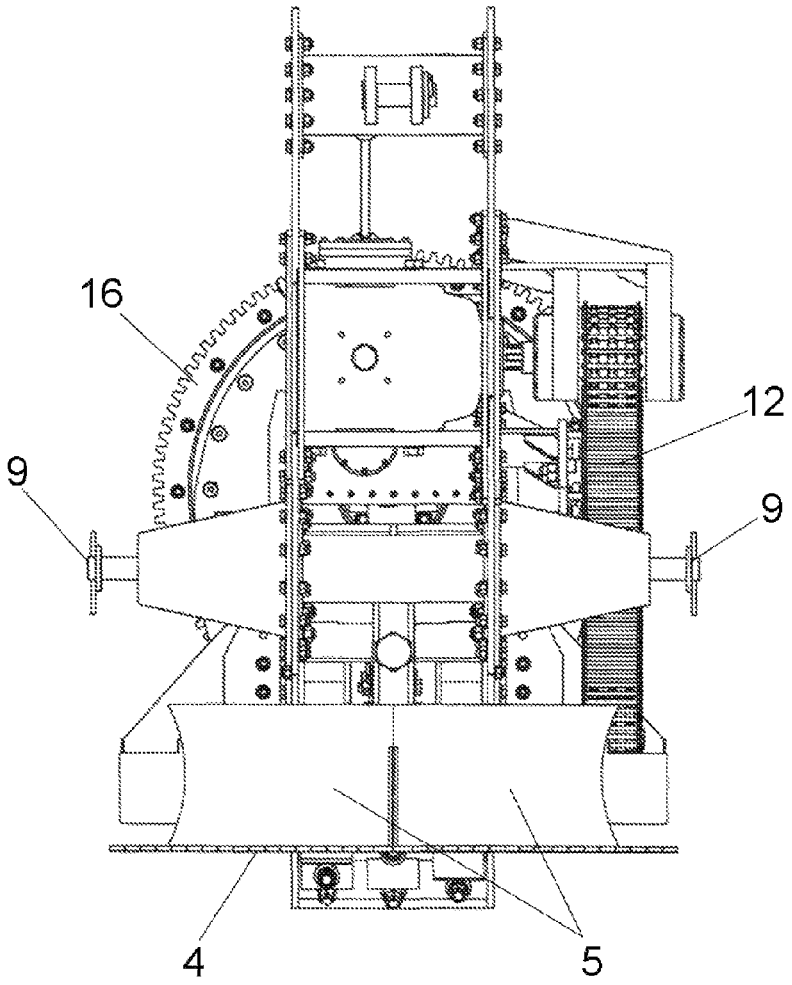
FIG. 2 shows a front view of the machine represented in the preceding figure.

Several embodiments can be carried out with all the elements described above, pointing out the following four embodiments:

The embodiment represented in FIGS. 1, 2 and 5

The embodiment represented in FIGS. 3 and 4

A third version with the throwing module similar to the one represented in FIG. 5, but with the transmission on the part opposite to the one represented in this figure, replacing the universal joint with a pulley, i.e. in this case the transmission is in the rear part of the flywheel and the materials entering by means of a worm screw on the side opposite the transmission.

Figure 6:
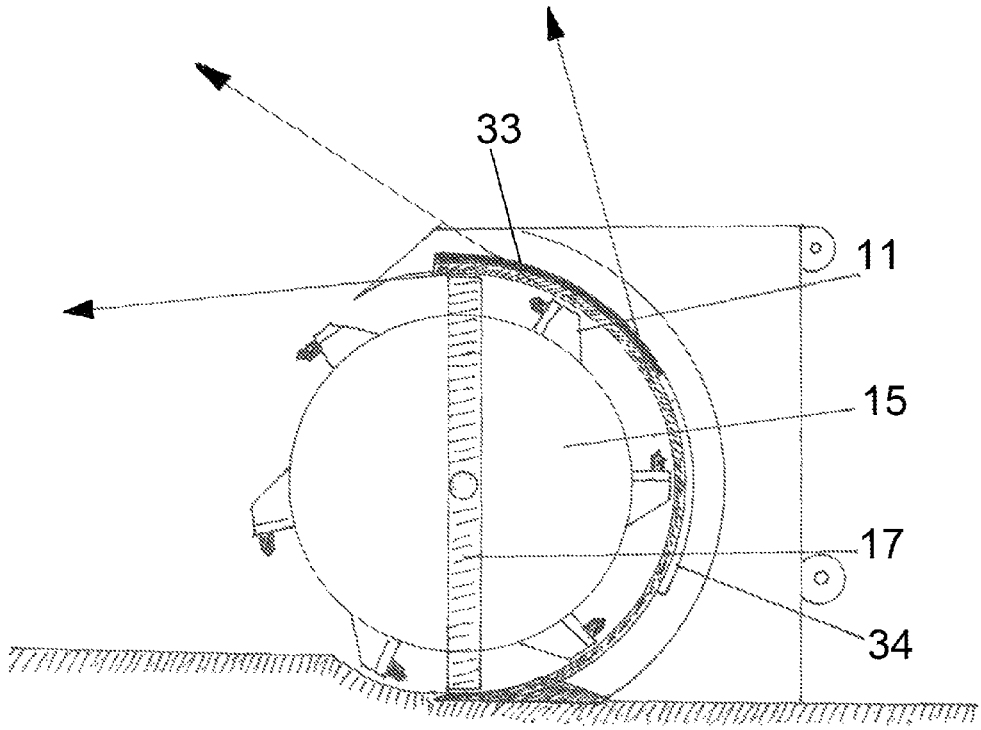
FIG. 6 shows a detailed view of one of the flywheels with the spikes placed on its periphery, corresponding to one of the embodiments of the invention.

A fourth and final embodiment, mounted on a single drive shaft, in which the milling cutter simultaneously excavates and throws, as can be seen in detail in FIG. 6; in this case its semicircular casing (33) is moved up or down, mechanically or manually guided in the side grooves (34), directing the stream of excavated material according to the operator's criteria at a vertical angle of up to 70°, as indicated by the directional arrows represented in FIG. 6.

In turn, as regards the throwing module, there are four different embodiments:

Corresponding to the throwing module represented in FIGS. 1, 2 and 5

Throwing module represented in FIGS. 3 and 4

Throwing module similar to the one represented in FIG. 5, but with the transmission in the rear part of the flywheel and the materials entering by means of a worm screw on the side opposite the transmission Throwing module represented in FIG. 6 similar to the one represented in FIGS. 3 and 4, but with the spikes (11) placed on the periphery of the flywheels (15), in which case the excavation and throwing functions are combined in one module.

The invention claimed is:

1. A machine for extinguishing fires, which uses as extinguishing component material ripped from a superficial strip of a ground, and comprising a brush cutting module, an excavating module and a throwing module, said modules removably mounted on a common chassis, wherein:

the brush cutting module, for eliminating brush from the ground surface, comprises in turn:

a support, at least a cutting knife mounted on the support for cutting the brush, at least two lateral panels, oblique with respect to the cutting knife, to direct the cut brush;

the excavating module to excavate a superficial strip of the ground from which brush is eliminated by the brush cutting module, the excavating module comprising in turn:

a milling cutter for ripping the superficial strip of the ground, and one or more spikes, attached to the perimetral edge of the milling cutter for crushing the superficial strip of the ground obtaining crushed material; and the throwing module for projecting on a fire the crushed material by the excavating module, comprises in turn:

at least one rotatory shaft, at least one inertia flywheel mounted on the rotatory shaft, one or more radial blades attached to the perimetral edge of the inertia flywheel for projecting the crushed material coming from excavating module, a surrounding movable casing having a through opening defined by the casing for allowing the crushed material projected by the radial blades to pass through, and a hydraulic actuator for rotating the casing and directing the projected material.

2. The machine of claim 1, wherein the cutting knife of the brush cutting module has a "swallowtail" shape and comprises replaceable saw teeth.

3. The machine of claim 1, wherein the support of the brush cutting module is adjustable in height.

4. The machine of claim 1, wherein the brush cutting module further comprises a hydraulic motor having a cam for generating vibrations on said brush cutting module.

5. The machine of claim 1, wherein the brush cutting module further comprises concave cutting discs attached to the support for additional cutting of the brush.

6. The machine of claim 1, wherein the spikes of the excavating module are replaceable.

7. The machine of claim 1, wherein the excavating module further comprises one or more pushing paddles, attached to the perimetral edge of the milling cutter in an alternate manner with the spikes, for pushing the material to the throwing module.

8. The machine of claim 1, wherein the spikes of the excavating module consist of hoe-like cutting devices.

9. The machine of claim 1, wherein the casing of the throwing module has a substantially semicircular shape and is coaxial to the rotatory shaft.

10. The machine of claim 1, wherein the throwing module further comprises a lever for selecting the direction of the rotation of the rotatory shaft and the radial blades for varying the throwing direction.

* * * * *